US005876359A

United States Patent [19]

Bock et al.

[11] Patent Number: 5,876,359

[45] Date of Patent: Mar. 2, 1999

[54] SEQUENTIAL COMPRESSION DEVICE CONTROLLER

[76] Inventors: Malcolm G. Bock, 8 Tubwreck Dr., Medfield, Mass. 02052; John F. Dye, 40 Dickens St., Bridgwater, Mass. 02324; David L. Murphy, 130 N. Washington St. Apt. 302, N. Attleboro, Mass. 02760

[21] Appl. No.: 338,310

[22] Filed: Nov. 14, 1994

[51] Int. Cl.[6] ..... A61H 7/00; A61H 19/00

[52] U.S. Cl. ..... 601/150; 601/152; 606/201

[58] Field of Search ..... 601/150, 152, 601/148, 149, 151; 606/202, 201; 128/DIG. 20

[56] References Cited

U.S. PATENT DOCUMENTS

| | | | |
|---|---|---|---|
| 4,013,039 | 3/1977 | Hasty | 601/152 |
| 4,029,087 | 6/1977 | Dye et al. | 604/152 |
| 4,375,217 | 3/1983 | Arkans | 601/152 |
| 4,396,010 | 8/1983 | Arkans | 128/24 R |
| 4,521,167 | 6/1985 | Cavalleri et al. | 418/82 |
| 4,583,255 | 4/1986 | Mogaki et al. | 601/150 |
| 4,957,107 | 9/1990 | Sipin | 128/204 |

OTHER PUBLICATIONS

International Publication No: WO 93/12708 (Inventor: LINA, Cesar, Z.), Dec. 1991.
Kend EP 000542383 A2, May 1993.

*Primary Examiner*—Robert A. Hafer
*Assistant Examiner*—Justine R. Yu
*Attorney, Agent, or Firm*—David J. Koris

[57] ABSTRACT

A controller for applying sequential compression to a patient's limb includes a variable speed motor connected to a rotary vane pump, and an electronic control circuit to drive the motor at a speed which will in turn drive the pump at a corresponding speed to provide intended output pressure. The controller provides automatic regulation of preset pressure and operates in a fully automatic manner. The controller is contained within a compact housing which can be floor or bed mounted and which has an output connector integral with a unitary manifold assembly for coupling to a tubing set by which sequentially pressurized air is directed to respective compartments of one or more compression sleeves disposed about a patient's limbs.

13 Claims, 8 Drawing Sheets

SEQUENTIAL COMPRESSION DEVICE CONTROLLER

FIELD OF THE INVENTION

The present invention relates to apparatus for applying compressive pressures to a patient's limb.

BACKGROUND OF THE INVENTION

Blood flow in patient's extremities, particularly the legs, markedly decreases during extended terms of confinement. Such pooling or stasis is particularly acute in surgery and during recovery periods immediately thereafter.

Blood flow compressive devices, such as shown in U.S. Pat. Nos. 4,013,069 and 4,030,488 develop and facilitate the application of compressive pressures against a patient's limb and in so doing promote venous return. The devices comprise a pair of sleeves which are wrapped about the patient's limbs, with a controller for supplying the pressurized fluid to the sleeves. Such sleeve devices are disclosed in U.S. Pat. Nos. 4,402,312 and 4,320,746.

One use for the above-mentioned devices is the prevention of deep venous thrombosis (DVT) which sometimes occurs in surgical patients when they are confined to bed. When a DVT occurs, the valves that are located within the veins of the leg can be damaged which in turn can cause stasis and high pressure in the veins of the lower leg. Patients who have this condition often have leg swelling (edema) and tissue breakdown (venous stasis ulcer) in the lower leg.

In a known controller, fluid supplied by the controller to the sleeves is generated by a piston compressor, and the flow is controlled by a flow control valve which is part of a separate flow control assembly to provide intended flow and pressure to the sleeves. The separate flow control assembly adds to the complexity and cost of the equipment. The size and weight of the equipment is also affected by the presence of the flow control assembly and the linear piston compressor typically employed.

In U.S. Pat. No. 5,031,604 a controller for applying compressive pressure to a patient's limb employs a linear oscillator compressor driven by a pulse signal the number of which is adjusted to energize and de-energize the compressor to provided intended output pressure. Feedback pressure control is employed using a pressure sensor.

SUMMARY OF THE INVENTION

The present invention provides an improved controller system for applying sequential compression to a patient's limb. The system is microprocessor based and has automatic pressure adjustment and maintenance to provide preset pressure irrespective of patient position or movement. The system once properly installed is fully automatic in its operation. A variable speed DC motor is connected to a rotary vane pump, the motor speed being controlled by an electronic control circuit to drive the motor at a speed which will in turn drive the pump at a corresponding speed to provide intended output pressure.

According to the invention, the flow and pressure are produced and controlled by a single assembly which comprises the rotary vane pump and electronic drive circuit. The rotary vane pump is smaller and lighter than conventional piston pumps used in known controllers and permits the overall controller to be of smaller size and weight for ease of transportability and installation. The present controller is also less complex than conventional controllers and has improved reliability by virtue of the reduced number of components. The DC driven pump allows the system to be easily modified to meet international electrical power requirements, as only the transformer of the AC power supply need be changed to suit local voltage standards. The present controller also permits the flow and pressure to be adjusted in real time to suit the needs of the particular compression application.

The controller provides automatic regulation of preset pressure. In a preferred embodiment, there are no front panel controls for user modification or adjustment of operating pressure. The only user controls are an on-off switch for activation and deactivation of the system, and a cooling switch. In an alternative embodiment, the operating pressure can be user selectable such as from a front panel control. The front panel includes an alphanumeric display for messages to a user and indicator lights to provide a visual indication of particular system operation. In the event of fault conditions, an alarm will sound and an appropriate fault code will be displayed on the alphanumeric display and the system will shut down.

In a cooling or ventilation mode which is selected by actuation of a cooling switch on the front panel, air is provided by the controller to the vent input of the compression sleeves which include openings for conveying air onto the patient's limb. With the cooling switch off, the cooling mode is deactivated and no ventilating or cooling air is provided by the controller to the sleeves. The system, in present implementation, when initially energized operates with the cooling mode off. In order to activate the cooling mode, the cooling switch is pressed on the front panel and the cooling LED illuminates to denote that the cooling mode has been selected.

The controller is housed in a compact housing having a handle for easy transport of the unit and having a bracket on the rear of the housing which serves as a foot when the unit is placed on a floor or other generally horizontal mounting surface, and which also serves as a support bracket when the unit is hung on the footboard of a patient's bed. A unitary manifold assembly is contained in the housing and includes a pneumatic connector, the outputs of which are coupled via suitable tubing to the compression sleeves. A pressure transducer is also coupled to the manifold assembly for monitoring output pressure. Solenoid valves are part of the manifold assembly, each solenoid valve being cooperative with a respective output port of the assembly for control thereof.

The tubing set couples the output ports of the controller to respective chambers of the one or more compression sleeves. The sleeves and tubing are shown for example in the aforesaid U.S. Pat. Nos. 4,402,312 and 4,320,746.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
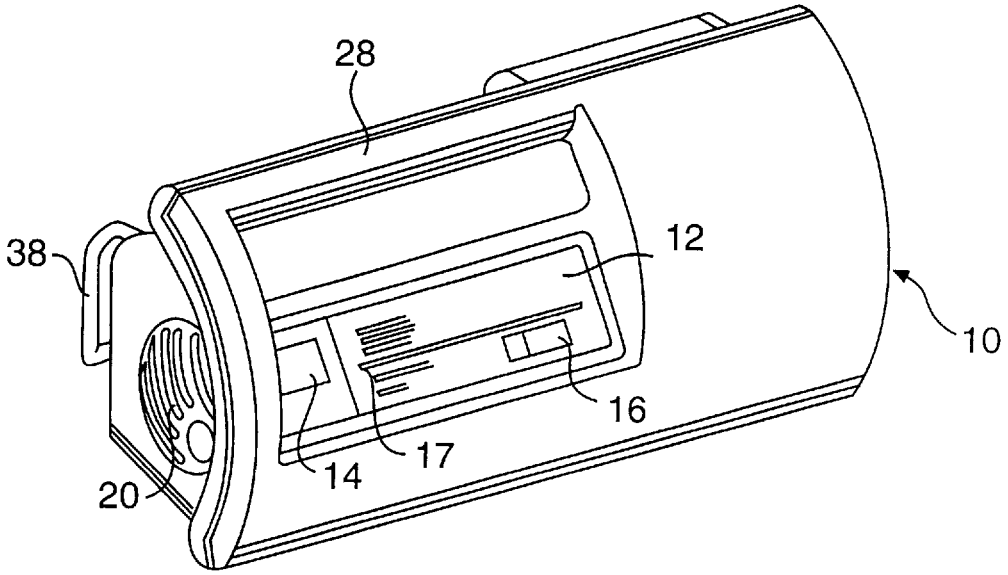
FIG. 1 is a pictorial view of the controller as housed.
Figure 2:
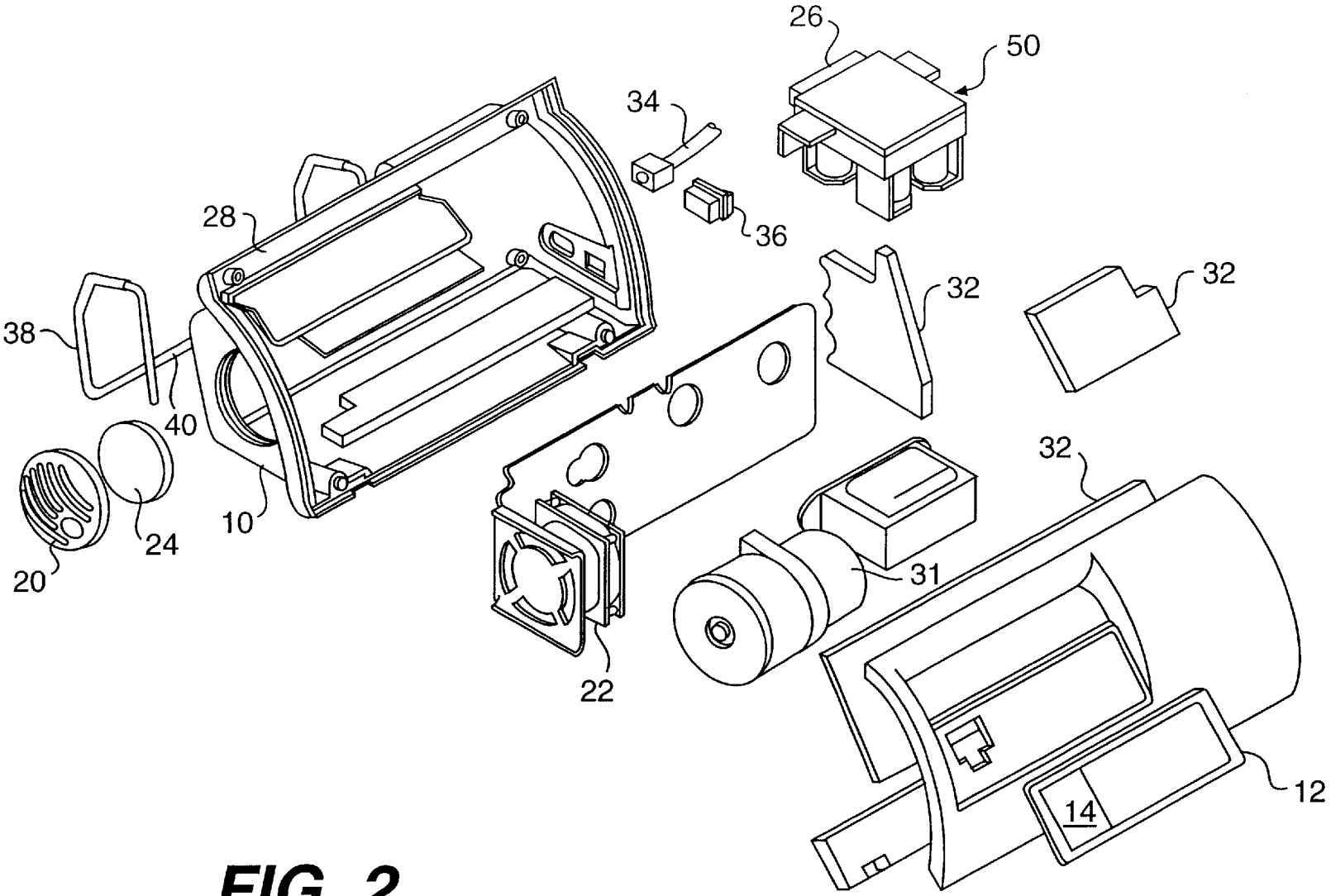
FIG. 2 is an exploded view of major components of the controller.

The controller is illustrated in FIGS. 1 and 2 and includes a compact readily transportable housing 10. A control or front panel 12 is provided on the front of the housing and includes controls and indicators for system operation. The control panel includes a display 14 which typically is an LED display to provide messages and indications to an operator. The panel also includes a cooling mode switch 16. The switch is preferably a membrane type switch actuated by finger pressure on the switch area delineated on the front panel.

The front panel also includes visual indicators, preferably light emitting diodes (LED's) (not shown) to indicate inflation and cooling modes. An air grill 20 is provided on a side of the housing by which cooling air is drawn into the housing by a fan 22 disposed proximate to the grill. A fan filter 24 is interposed between the grill and fan for filtering dust and other particles from the input air. The grill and filter element are readily removable for cleaning or replacement of the filter. An output connector 26 is disposed on the rear of the housing and is adapted to be connected to a mating connector of a tubing set by which the controller is connected to one or more compression sleeves. The housing includes a handle 28 in which a sound muffler 30 (FIG. 3) is disposed for minimizing noise produced by the turbulent air being drawn into the compressor 31. The housing can be interiorly lined with acoustic foam 32 to further reduce operating noise. A power cord 34 extends from the side of the housing opposite to the input air grill, and a power switch 36 is provided adjacent to the power cord on the housing side.

A bracket 38 is provided on the rear of the panel having a lower element 40 co-planar with the bottom surface of the housing and providing a hook by which the housing can be suspended from the foot board of a patient's bed. Alternatively, the housing can be placed on a floor or other supporting surface.

Figure 3:
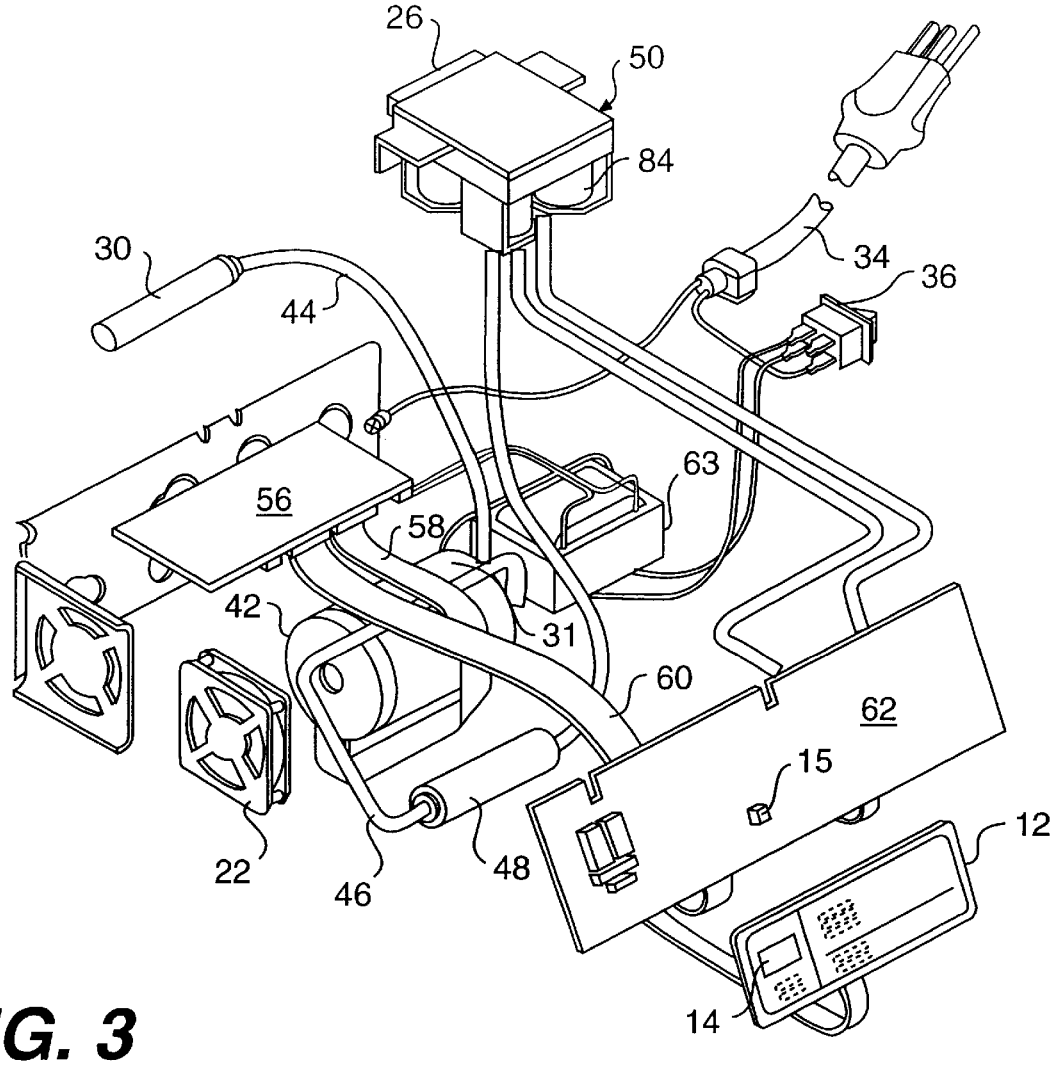
FIG. 3 is an exploded view of the pneumatic assembly and associated electrical power and control circuitry.
Figure 4:
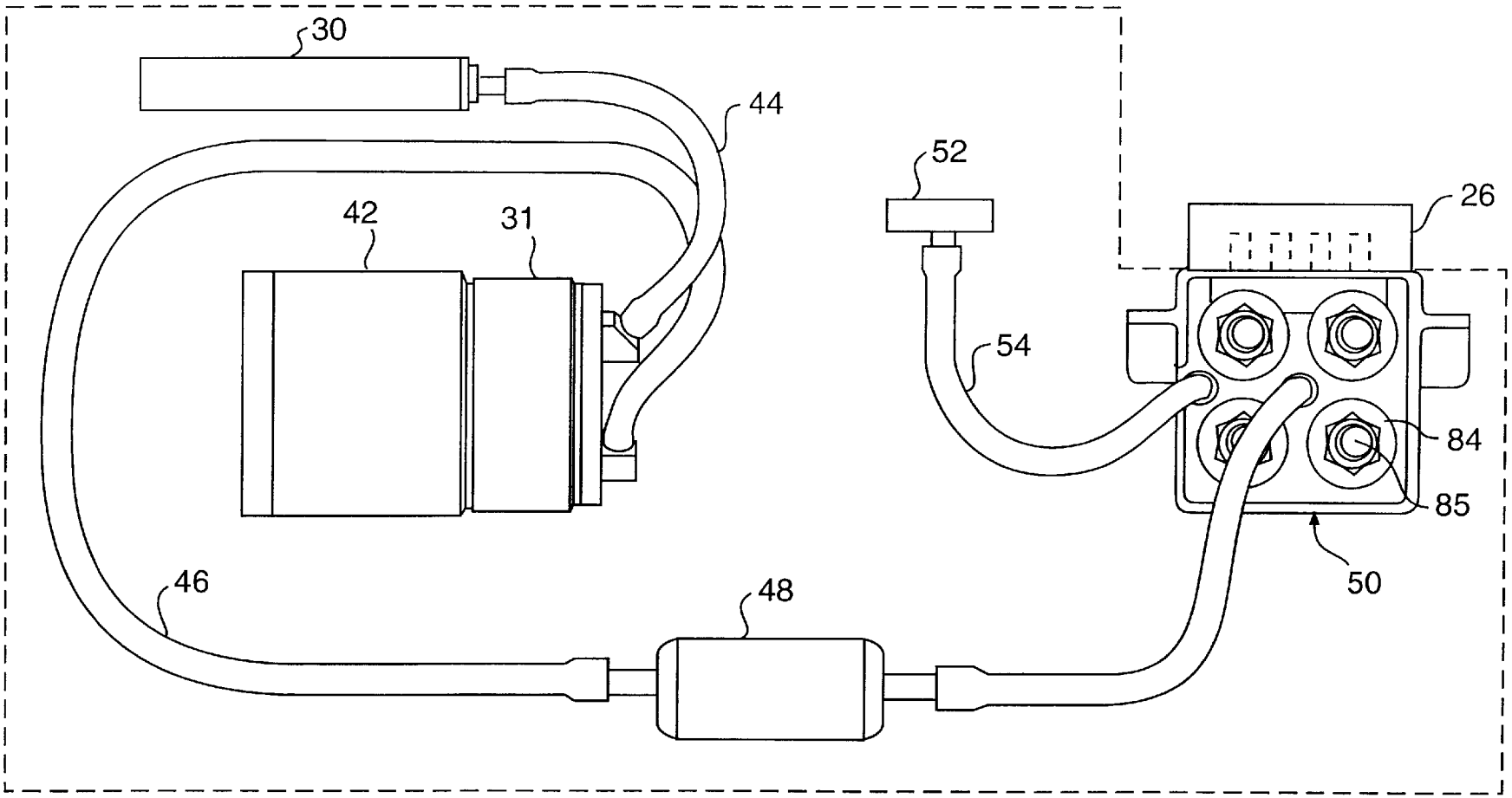
FIG. 4 is a plan view showing the pneumatic apparatus of the controller.
Figure 5:
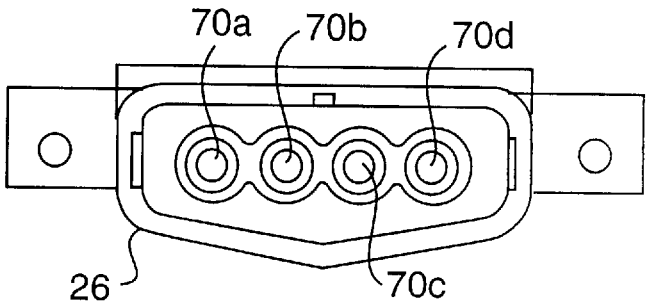
FIG. 5 is an end view of the pneumatic output connector of the controller.
Figure 6:
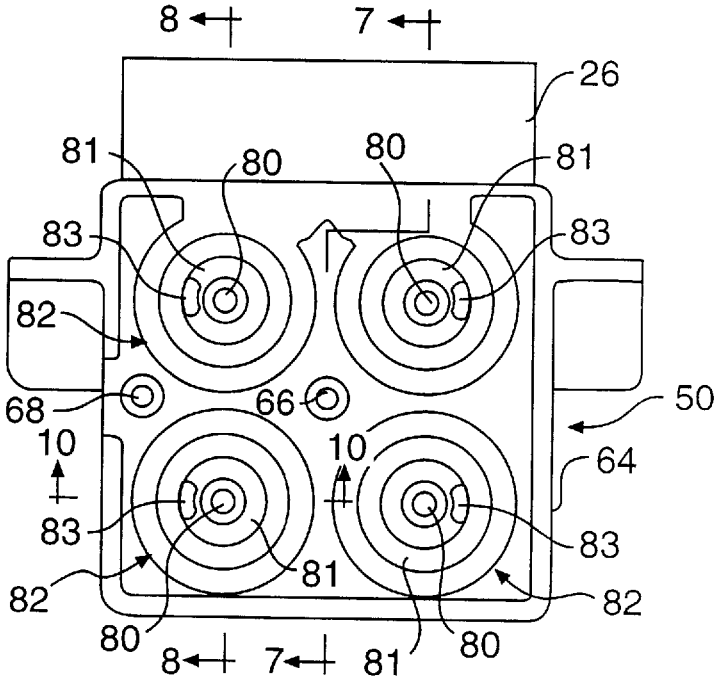
FIG. 6 is a top view of the manifold housing.
Figure 7:
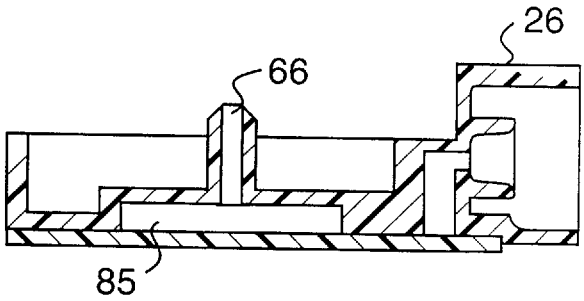
FIG. 7 is a cutaway view taken along lines 7—7 of FIG. 6.
Figure 8:
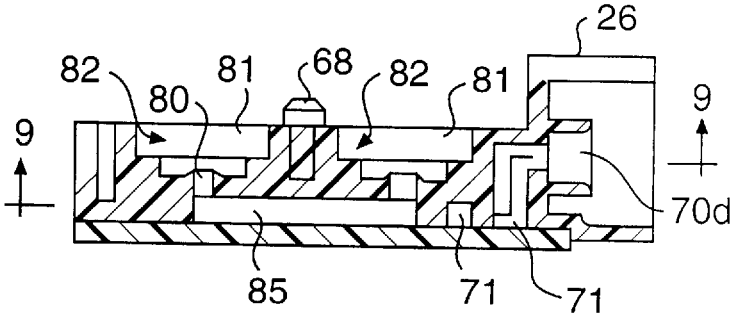
FIG. 8 is a cutaway view taken along lines 8—8 of FIG. 6.
Figure 9:
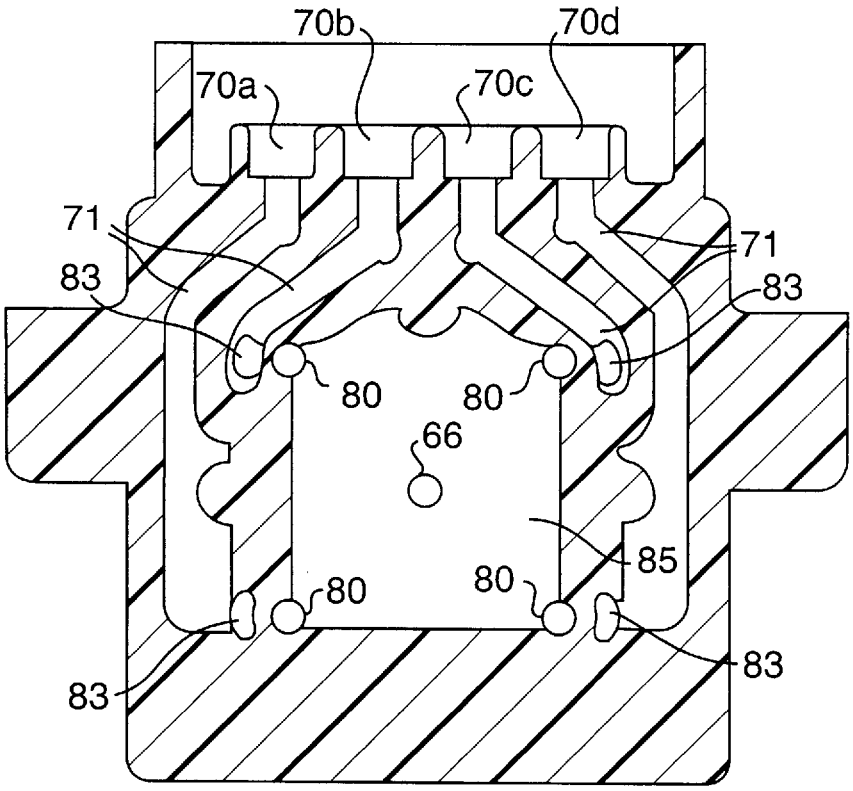
FIG. 9 is a cutaway view taken along lines 9—9 of FIG. 5.
Figure 10:
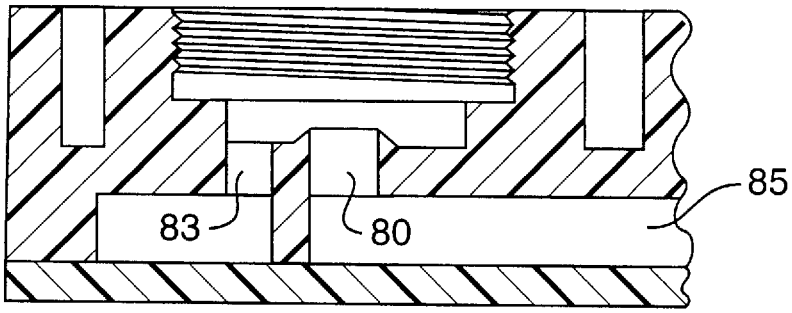
FIG. 10 is a partial cutaway elevation view taken along lines 10—10 of FIG. 6.

Referring to FIGS. 2 through 4, there is shown the compressor 31 directly connected to a variable speed DC motor 42 and having an inlet air tube 44 coupled to muffler 30, and an outlet air tube 46 coupled via air filter 48 to the input of manifold assembly 50. The motor is preferably a three phase brushless DC motor which is controllable by a solid state control circuit for providing fine speed control. The compressor is preferably a rotary vane compressor which operates at a high speed, typically 1000 rpm, and which is driven at a speed governed by the speed of motor 42 to provide intended output pressure. Alternatively, the pump can be a diaphragm pump. The speed of the motor 42 is electronically controlled to provide a corresponding compressor speed for respective output pressures as desired. A pressure transducer 52 is coupled via tubing 54 to the manifold assembly 50 for monitoring output pressure.

A power supply board 56 is connected to the motor 42 via a ribbon cable 58, and is also connected via a ribbon cable 60 to the processor board 62. Electrical power is provided to the system via a transformer 63.

The manifold assembly 50 is shown in detail in FIGS. 5 through 10 and comprises a unitary housing 64 which is typically fabricated of molded plastic, and having an input port 66, a transducer port 68 coupled to pressure sensor 52, and output ports 70*a* through 70*d* which are coupled to respective ports 80 of valve structures 82. Each of the valve structures has an associated solenoid 84 which is electrically driven via the processor on board 62. The solenoid is coupled to a valve seat which is threaded into the cooperative threaded opening in housing 64, the seat being operative to open and close the respective valve upon actuation of the solenoid.

Each of the valve structures 82 includes a cavity 81 having a central port or opening 80 in a surrounding valve seat, and a second opening 83 in the valve cavity. The central openings 80 of the valve cavities are in fluid communication with a chamber 85 in the housing and beneath the valve cavities, this chamber also being in communication with inlet port 66. The second openings 83 of the valve cavities are coupled to respective ports 70*a*–70*d* of the connector 26 via passages 71. A transducer port 68 is provided in communication with one of the output ports and adapted for coupling to a pressure sensor (FIG. 4) operative to monitor sleeve pressure when the compression system is assembled with the compression sleeves, interconnecting tubing and controller. In the present embodiment, the pressure sensor monitors the pressure in the ankle channel. Monitoring could be provided in any other channel or in multiple channels.

Figure 12:
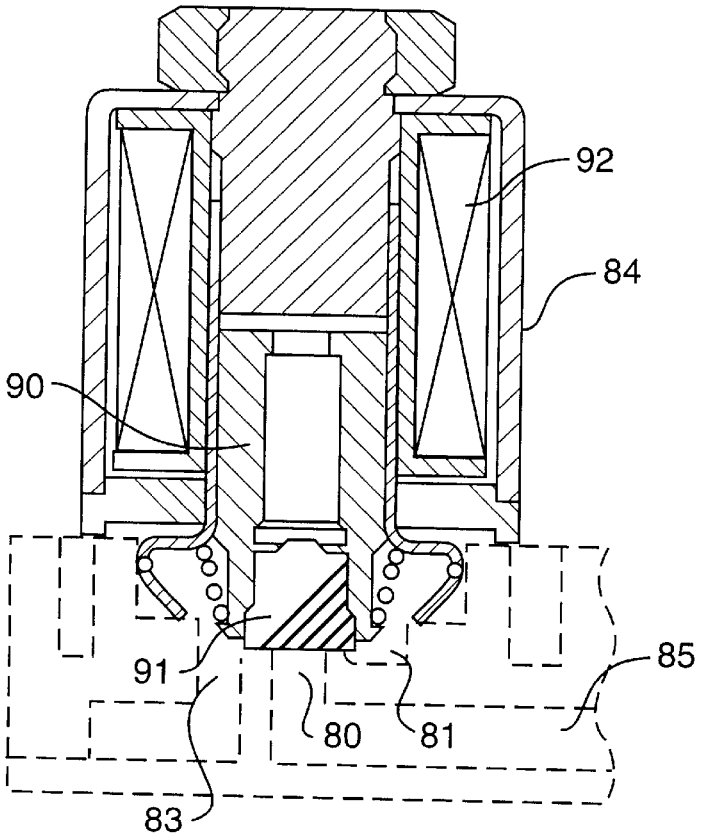
FIG. 12 is a cutaway elevation view of the two-way solenoid valve.
Figure 13:
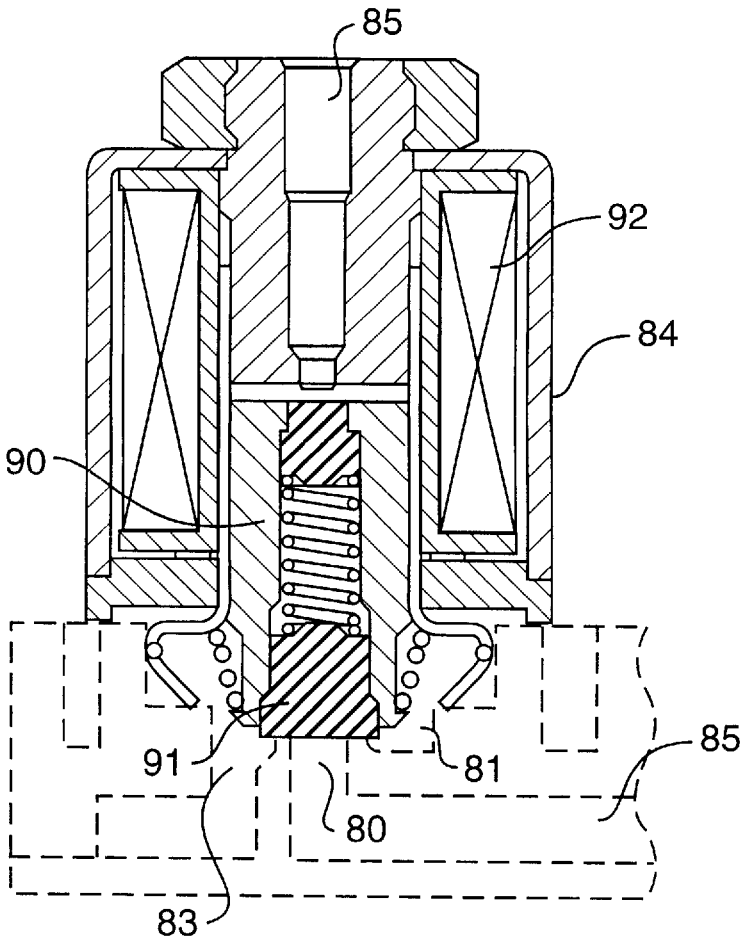
FIG. 13 is a cutaway elevation view of the three-way solenoid valve.

Referring to FIGS. 12 and 13, a solenoid 84 and associated valve components are mounted on each valve cavity 81. In the illustrated embodiment of FIG. 10 each of the solenoids is threadably retained in the respective valve cavity 81 by cooperative threads on the periphery of the valve cavity and associated threaded fitting (not shown) on the solenoid structure. FIGS. 12 and 13 illustrate an alternative mechanism for retaining the solenoids in the valve cavities. The solenoid structure includes a coaxially disposed plunger 90 having a seal 91 which in the downward or depressed position seats over the central port 80 to stop fluid flow therethrough. The plunger is operated by the solenoid coil 92. When the seal is in a raised or open position, fluid can flow from the central opening 80 and thence through the second opening 83 to the corresponding port 70 of the output connector 26.

The valve 84 connected to the cooling port 70*b* of the output connector is a two-way, normally closed valve, shown in FIG. 12. When normally closed, no air is provided to the cooling port of the connector. When the valve is actuated and the valve is open, air is permitted to flow to the cooling port of the connector and thence to the cooling channels of the compression sleeves. The other valves are three-way normally closed valves, as shown in FIG. 13, which have a coaxial port or opening 85 through the top of the solenoid structure which communicates with the annular space between the plunger 90 and the surrounding wall. In the open position, air flows from the center port 80 to the second port 83 and thence to the associated output port 70 of the connector 26 and into the compression sleeves. In the closed position, the center port 80 is blocked by the depressed valve seal 91 and air from the sleeve chambers flows back through the connector port 70 and through the second opening 83 and out the vent port 85 of the associated valve.

The valves 84 associated with output ports 70*a*, 70*c*, and 70*d* are operated in sequence to pressurize the ankle, calf and thigh chambers of the compression sleeves and provide sequential pressurization of the chambers and venting of the chambers under the control of the microprocessor. The solenoid 84 for the cooling output port 70*b* is selectively actuated when cooling operation is desired.

Each of the solenoids is driven by pulse width modulated signals provided by the control circuit 108. The solenoid drive signals are at a first higher power level for rapid and positive actuation of the solenoid valves. After initial actuation, the valves are maintained in an actuated state by drive signals of a second lower power level, thereby to reduce power consumption. Typically, the first higher level drive signals have a duty cycle of 87%, while the second lower drive signals have a duty cycle of 75%.

The manifold assembly provides a compact pneumatic assembly which eliminates more complex conventional assemblies of separate valves, fittings and tubing. The unitary manifold assembly permits the controller to be very compact and easily transportable, and also provides a highly reliable structure which requires only a single input fitting and output connector and a sensor port.

The output ports 70*a*, 70*c*, and 70*d* are coupled via the mating connector and tubing set (not shown) to the multi-chamber compression sleeves adapted to fit around the legs of a patient. During the compression cycle, the solenoid valves are sequentially energized to pressurize, in sequence, the ankle, calf and thigh chambers of both sleeves. At the end of this compression cycle, the solenoid valves are simultaneously de-energized to disconnect the compressor from the sleeves and to allow the valves to vent sleeve pressure to the atmosphere via the vent ports 85 on the manifold assembly. The pressure transducer 52 monitors the pressure at the ankle portion of the pneumatic circuit and provides an electrical signal input to the microprocessor for purposes of feedback control. The ventilation or cooling port 70*b* of the manifold assembly 50 is coupled via the corresponding tube of the tubing set to the ventilation or cooling opening of the sleeves to provide air flow through the sleeve walls for cooling purposes when the cooling mode is activated by front panel control 16.

The solenoid valve coupled to the vent port 70*b* of the manifold assembly 50 is a two-way normally closed valve. When energized, air is passed from the compressor 31 to the ventilation or cooling port 70*b* and thence to the ventilation tubing of the sleeves. When de-energized, flow is blocked.

The other solenoid valves are three-way normally closed valves. When in an open position, these valves allow passage of air from the compressor 31 to the respective output ports 70*a*, 70*c*, and 70*d*. When de-energized and therefor in a closed position, the compressor air is blocked and air pressure in the sleeves is released through the venting ports 85 on top of the associated solenoid valves. When the cooling mode is off, the compressor 31 can be turned off during the vent portion of a cycle.

The solenoid valves are driven in a two-stage manner with a higher power drive signal provided to initially energize the valves and a lower power signal thereafter provided to maintain or hold the valves in an energized state. The solenoid valves and the DC motor are driven by pulse width modulated (PWM) electrical signals generated by the control circuitry.

Figure 11:
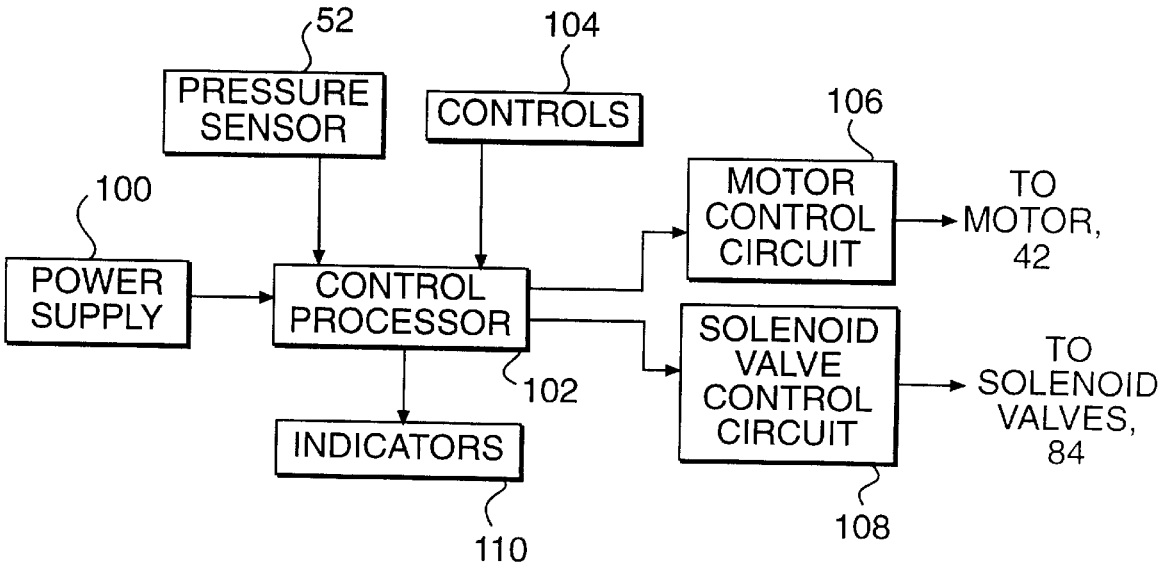
FIG. 11 is a block diagram of the electronic circuitry of the invention.

The electrical system is illustrated in block diagram form in FIG. 11. A power supply 100 provides electrical power to the control processor 102 which receives an input from pressure sensor 52 and from controls 104. The controller processor 102 provides output signals to motor control circuit 106 which in turn provides drive signals to motor 42. The control processor 102 also provides output signals to control circuit 108 which provides drive signals to solenoid valves 84. Indicators 110 are also driven by output signals from the control processor 102. Under the control of processor 102, the motor control circuit 106 provides pulse width modulated signals to motor 42, the modulation being varied to control the speed of the motor and corresponding speed of the compressor 31 to provide intended output pressure. Also under control of processor 102, the solenoid valve control circuit 108 provides pulse width modulated signals to the solenoid valves 84 for energizing the valves. The valves are driven in a two-stage manner, with a higher power drive signal provided by control circuit 108 to initially energize the valve, and a lower power signal thereafter provided by control circuit 108 to maintain the valve in its energized state.

Fault conditions are detected and processed by the control processor 102, and upon such detection normal operation of the system is interrupted by closure of all solenoid valves 84, and with the appropriate fault code being displayed on the front panel display 14 and an audible alarm also sounded via an audible indicator 15 mounted beneath the front panel. Typically the control processor includes an automatic restart circuit which will be activated to initiate a resetting or restarting operation. If upon such restarting, the cause of the malfunction or fault is still present, the system will typically continue to attempt to restart and during such restarting attempts, the audible alarm will beep. The system can be implemented such that after a predetermined period of time or number of restart attempts, the system will shut down under command from processor 102, if a fault condition remains.

The system operates in the following manner. When the system is initially switched on, a series of self-tests are conducted under government of the processor 102. All of the LED indicators are illuminated and the beeper is sounded for about ½ second to verify the operability of the visual and audible indicators. Next the multi-segment display is illuminated to verify display operability. Next, the cycle monitor LEDs (inflate and vent) illuminate momentarily and thereafter the cooling LED illuminates momentarily. In a second test phase, the pre-set pressure, typically 45 mmHg is displayed and the compressor speed is adjusted to provide the predetermined start pressure for ankle inflation. The system then commences the inflation cycle for sequential inflation of the ankle, calf and thigh chambers of the attached compression sleeves. The system is also operative in a pressure monitor mode by which an operator can read displayed actual pressure. This mode is actuated by a front panel control 17 which is a touch sensitive area of the front panel. In the pressure monitor mode, a decimal point or other portion of the display will flash to indicate that actual pressure is being displayed. When not in the pressure monitor mode, the displayed pressure is the pre-set pressure. The system will maintain the pre-set pressure automatically by feedback control governed by the processor.

The fault messages indicate abnormal pressure or absence of pressure to the connected tubing and sleeves and diagnostic messages indicating conditions requiring system repair.

Various modifications and alternative implementations can be made without departing from the spirit and scope of the present invention. Accordingly, the invention is not to be limited by what has been particularly shown and described except as indicated in the appended claims.

We claim:

1. A controller for applying sequential compression to one or more compression sleeves disposable about a patient's limb or limbs, the controller comprising:

an electronically controlled motor operable at a variable motor speed;

a compressor operable at a variable compressor speed and coupled to the motor and providing an output pressure corresponding to the compressor speed;

a manifold assembly comprising a housing including an input port and a plurality of output ports disposed in an output connector, the manifold assembly further comprising a plurality of electrically operable valves each cooperative with a respective output port;

circuitry including a first circuit providing first drive signals to the motor and a second circuit providing second drive signals to the electrically operable valves;

the output connector operative for connection to a tubing set for fluid coupling of the controller to one or more compression sleeves;

a processor in communication with the first circuit and the second circuit for governing operation of the circuitry to provide an intended compression and decompression cycle;

the motor speed of the motor being adjusted in accordance with the first signals to provide a corresponding adjustment of the compressor speed to provide intended output pressure to each of the output ports of the output connector.

2. The controller of claim 1 wherein the compressor is a rotary vane compressor.

3. The controller of claim 1 wherein the motor includes a shaft and the compressor is a rotary vane compressor which is directly coupled to the shaft of the motor.

4. The controller of claim 1 wherein the motor is a brushless DC motor.

5. The controller of claim 1 wherein the first circuit provides as the first drive signals pulse width modulated first drive signals to the motor.

6. The controller of claim 1 wherein the second circuit provides as the second drive signals pulse width modulated second drive signals to the electrically operable valves.

7. The controller of claim 1 wherein the first circuit provides as said first drive signals pulse width modulated signals to the motor, and the second circuit provides as said second drive signals pulse width modulated signals to the electrically operable valves.

8. The controller of claim 7 wherein the pulse width modulated signals from said second circuit are of a first level to energize the electrically operable valves and are of a second lower level to maintain the electrically operable valves in an energized state.

9. The controller of claim 1 wherein the electrically operable valves are solenoid valves.

10. The controller of claim 9 wherein the solenoid valves are sequentially actuated to provide sequential pressure to the output ports.

11. The controller of claim 1 wherein the processor is operative to cause sequential actuation of the valves to provide sequential output pressure at the output ports of the output connector.

12. The controller of claim 1 wherein the manifold assembly has an integral housing containing the input port and the output connector having the plurality of output ports, the electrically operable valves being operatively connected to the plurality of output ports.

13. The controller of claim 1 wherein the manifold assembly includes a sensor port coupled to a pressure sensor for monitoring pressure in at least one of said output ports.

* * * * *